US011854777B2

(12) United States Patent
Silivra et al.

(10) Patent No.: US 11,854,777 B2
(45) Date of Patent: Dec. 26, 2023

(54) ION-TO-ELECTRON CONVERSION DYNODE FOR ION IMAGING APPLICATIONS

(71) Applicant: Thermo Finnigan LLC, San Jose, CA (US)

(72) Inventors: Oleg Silivra, Milpitas, CA (US); Alan E. Schoen, Kilauea, HI (US); Johnathan W. Smith, Round Rock, TX (US); Berg A. Tehlirian, Daly City, CA (US)

(73) Assignee: Thermo Finnigan LLC, San Jose, CA (US)

( * ) Notice: Subject to any disclaimer, the term of this patent is extended or adjusted under 35 U.S.C. 154(b) by 391 days.

(21) Appl. No.: 16/941,124

(22) Filed: Jul. 28, 2020

(65) Prior Publication Data

US 2021/0035789 A1 Feb. 4, 2021

Related U.S. Application Data

(60) Provisional application No. 62/879,605, filed on Jul. 29, 2019.

(51) Int. Cl.
*H01J 43/24* (2006.01)
*H01J 49/02* (2006.01)

(52) U.S. Cl.
CPC ..... *H01J 43/246* (2013.01); *H01J 49/025* (2013.01)

(58) Field of Classification Search
CPC ..... H01J 43/246; H01J 49/025; H01J 49/0095
See application file for complete search history.

(56) References Cited

U.S. PATENT DOCUMENTS 3,760,216 A * 9/1973 Lasser ..... H01J 43/246 313/506
3,902,240 A * 9/1975 Chang ..... H01J 43/246 445/47

(Continued)

FOREIGN PATENT DOCUMENTS

FR 2618605 A1 1/1989
JP 2007012309 A 1/2007
WO WO8900883 A1 2/1989

OTHER PUBLICATIONS

Bruins, "A Simple and Inexpensive Modification of a Finnigan 3300 Quadrupole Mass Spectrometer for Negative Ion Detection," Biomedical Mass Spectrometry, vol. 10, No. 1, 1983, pp. 46-49.

(Continued)

*Primary Examiner* — Kevin Quarterman

(57) ABSTRACT

A metal-channel conversion dynode comprises: a wafer comprising a first face and a second face parallel to the first face and having a thickness less than 1000 μm; and a plurality of channels passing through the wafer from the first face to the second face at an angle to a plane of the first face and a plane of the second face. In some embodiments, each inter-channel distance may be substantially the same as the wafer thickness. In some embodiments, the wafer is fabricated from tungsten. In some other embodiments, the wafer comprises a non-electrically conductive material that is fabricated by three-dimensional (3D) printing or other means and that is coated, on its faces and within its channels, with a metal or suitably conductive coating that produces secondary electrons upon impact by either positive or negative ions.

9 Claims, 10 Drawing Sheets

(56) References Cited

U.S. PATENT DOCUMENTS

| | | | | |
|---|---|---|---|---|
| 4,423,324 | A | 12/1983 | Stafford | |
| 4,810,882 | A | 3/1989 | Bateman | |
| 5,086,248 | A * | 2/1992 | Horton | H01J 9/12 313/105 CM |
| 5,463,218 | A | 10/1995 | Holle | |
| 8,389,929 | B2 | 3/2013 | Schoen et al. | |
| 8,890,086 | B1 * | 11/2014 | Goldberg | H01J 43/246 250/397 |
| 8,969,823 | B2 * | 3/2015 | Elam | C23C 16/45555 250/390.01 |
| 9,524,855 | B2 | 12/2016 | Schoen et al. | |
| 2003/0057378 | A1 * | 3/2003 | Pierrejean | H01J 49/08 250/287 |
| 2004/0041092 | A1 | 3/2004 | Yamaguchi et al. | |
| 2012/0187305 | A1 * | 7/2012 | Elam | C23C 16/45555 257/E31.086 |
| 2016/0217990 | A1 | 7/2016 | Smith et al. | |
| 2016/0314947 | A1 | 10/2016 | Mane et al. | |
| 2018/0247802 | A1 * | 8/2018 | Nagata | H01J 43/246 |
| 2020/0027709 | A1 * | 1/2020 | Nagata | H01J 43/246 |

OTHER PUBLICATIONS

Prodanovic et al., "Effect of thermal annealing and chemical treatments on secondary electron emission properties of atomic layer deposited MgO", J. Vac. Sci. Technol. A 36, 06A102 (2018), 11 pages; https://doi.org/10.1116/1.5040813.

Vaz et al., "Measurement of the secondary electron emissionfrom CVD diamond films using phosphor screen detectors", Journal of Instrumentation 10 (2015), P03004, 17 pages.

Shi et al. "Secondary Electron Emission Studies" Applied Surface Science, 1997, pp. 251-258.

* cited by examiner

31

ION-TO-ELECTRON CONVERSION DYNODE FOR ION IMAGING APPLICATIONS

CROSS-REFERENCE TO RELATED APPLICATION

This application claims, under 35 USC § 119(e), priority to and the benefit of the filing date of U.S. Provisional application No. 62/879,605, titled "Ion-to-Electron Conversion Dynode for Ion Imaging Applications" and filed on Jul. 29, 2019, the disclosure of which is hereby incorporated by reference in its entirety.

TECHNICAL FIELD

The present disclosure relates to mass spectrometry and mass spectrometers. More particularly, the present disclosure relates to mass spectrometer systems for detecting either positively-charged or negatively-charged ions.

BACKGROUND

Conversion dynodes are well known in the art and are frequently employed in ion detectors used in mass spectrometry, which include electron-multiplier detectors and photo-multiplier detectors. Such devices rely on the phenomenon of secondary emission, whereby transfer of energy from energetic particles to a material or surface causes, upon impact with the material or surface, emission of so-called "secondary particles" from the surface. Simply put, a dynode is an electrode maintained in a vacuum. When energetic ions impact a dynode surface, secondary electrons are emitted. This is true both for positive and negative ions. Based on this fact first detectors utilizing conversion dynode and electron multiplier were designed (U.S. Pat. Nos. 4,810,882 and 4,423,324). Unfortunately, to detect negative ions the conversion dynode must be held at high positive potential and multiplier with the output anode must be held at even higher positive potential. This requirement has created several technical challenges such as the necessity to handle a signal coming from a preamplifier floating at high potential, high noise created by microfinic effect and stray electrons and other problems. Those challenges were resolved by Stafford (U.S. Pat. No. 4,423,324) who proposed the mechanism of negative ion to positive ion conversion with subsequent detection of positive ions in a way similar to ion detection in "pure" positive ion mode. Since that time, this method of negative ion detection became an industry standard. In electron multiplier detectors, the initial flux of secondary particles, either protons or electrons, that are emitted from a first dynode are subsequently amplified (i.e., multiplied) and repeatedly re-amplified by a series of additional dynodes. In photo-multiplier detectors, the secondary particles (electrons) that result from impacts of ions at the conversion dynode are accelerated onto a phosphor screen at which their kinetic energy is converted into photons. Subsequently, repeated cycles (i.e., stages) of emission of electrons and photons amplify the photon signal as described further below.

The mechanism of interaction between primary ions impacting the surface of an ion-to-electron or ion-to-proton conversion dynode is fundamentally different than mechanics of electron-to-more-electrons phenomenon that is operative in electron multipliers. Electron to electron surface interaction requires electronic excitation and is dependent upon the surface's work function. Moreover, studies of secondary electron emission from boron-doped diamond coating samples (Shih, A., J. Yater, C. Hor, and R. Abrams. "Secondary electron emission studies." *Applied surface science* 111 (1997): 251-258.) reveal the multidimensional nature of this process involving properties of the coating post-processing, material conductivity, incident electrons energy and angle, etc. However, ion to secondary conversion does not depend on the work function. Historical research on the mechanisms of conversion dynode operation has conclusively demonstrated that the nature of the surface of the electrode material is not especially relevant. This research, in conjunction with time-of-flight investigations of the nature of ejecta from conversion dynode surfaces has led to the generally-accepted conclusion that desorption of contaminant species on the electrode surface is dominantly responsible for the emission of electrons in response to a flux of positive ions and the emission of protons in response to a flux of negative ions. Nevertheless, recent results on using a boron-doped diamond coating on conversion dynodes showed a significant (about 6×) increase of the secondary electrons in positive ion polarity (Poster 298433 TP 464, Proceedings of ASMS 2019 Conference, Atlanta, Georgia).

FIG. 1 schematically illustrates a triple-quadrupole mass spectrometer system, as generally designated by the reference numeral 1 that may employ an electron multiplier detector 10. The operation of mass spectrometer 1 can be controlled and data 11 can be acquired by a control and data system (not depicted) of various circuitry of one or more known types, which may be implemented as any one or a combination of general or special-purpose processors (digital signal processor (DSP)), firmware, software to provide instrument control and data analysis for mass spectrometers and/or related instruments. A sample containing one or more analytes of interest can be ionized via an ion source 5 operating at or near atmospheric pressure. The resultant ions are directed via predetermined ion optics that often can include tube lenses, skimmers, and multipoles, e.g., reference characters 6 and 7, so as to be urged through a series of chambers, e.g., chambers 2, 3 and 4, of progressively reduced pressure that operationally guide and focus such ions to provide good transmission efficiencies. The various chambers communicate with corresponding ports 12 (represented as arrows in FIG. 1) that are coupled to a set of vacuum pumps (not shown) to maintain the pressures at the desired values.

The example mass spectrometer system 1 of FIG. 1 is illustrated with a triple-stage configuration 8 within a high vacuum chamber 9, the triple-stage configuration having sections labeled Q1, Q2 and Q3 electrically coupled to respective power supplies (not shown). The Q1, Q2 and Q3 stages may be operated, respectively, as a first quadrupole mass filter, a fragmentation cell, and a second quadrupole mass filter. Ions that are either filtered, filtered and fragmented or fragmented and filtered within one or more of the stages are passed to the detector 10. Such a detector is beneficially placed at the channel exit of the quadrupole (e.g., Q3 of FIG. 1) to provide data that can be processed into a rich mass spectrum 11 showing the variation of ion abundance with respect to m/z ratio. During conventional operation of a multipole mass filter, such as the quadrupole mass filter Q3 shown in FIG. 1, to generate a mass spectrum, the detector 10 is used to measure the quantity of ions that pass completely through the mass filter as a function of time while the RF and DC voltage amplitudes are scanned.

FIG. 2A is a schematic illustration of an imaging detector system 21 for a mass spectrometer that is based on the principle of photomultiplication, as taught in U.S. Pat. Nos.

8,389,929 and 9,524,855 both of which are incorporated by reference herein in their entireties. The imaging detector system 21 illustrated in FIG. 2A includes a metal-channel conversion dynode (MCD) 16 that serves to generate secondary electrons in proportion to ions that exit the mass spectrometer and a plurality of phosphor-based gain stages. Application of the boron doped diamond coating or the like to the MCD surface may dramatically improve the efficiency of the ion to electron conversion and may comprise an additional gain stage. In the example shown in FIG. 2A, four such gain stages S1-S4 are illustrated. However, the number of gain stages that are employed need not be restricted to any particular number of stages.

In operation of the detector system 21, ions are accelerated in the direction of the MCD 16 by application of an electrical potential difference between an electrode of the mass spectrometer (not shown) and the MCD 16 or between the MCD 16 and an electrode 34 of the first gain stage S1, or both. The electrical potential difference is such as to provide ion impact energy of at least several kilo electron volts. For positive ions a typical value would be −10 kV. Secondary electrons, $e^-$, generated at the MCD are accelerated in the direction of a phosphor coating 22 disposed on a substrate plate 18 of the first gain stage S1 by application of an electrical potential difference between the MCD 16 and an electrode 34 comprising a thin conductive metallic coating disposed on the phosphor 22. This metal coating allows high energy electrons to pass and induce photon production in the phosphor. Further, the coating is optically reflective and increases the efficiency of the phosphor by redirecting back-emitted or backscattered photons towards the thin insulating glass, mica, plastic or preferably fiber optic substrate plate 18.

At the phosphor 22 of the first stage S1, the kinetic energy of the electrons is converted to radiant energy of emitted photons p by cathodoluminescence. Thus, the substrate plate 18 and its phosphor coating 22, taken together, may be considered to comprise an "electron-to-photon" converter. Alternatively, the combination of substrate plate 18, phosphor coating 22 and electrode 34, when taken together, may be considered to comprise the electron-to-photon converter, since these three components will generally—but not necessarily always—occur together. The similar components of gain stages S1, S2 and S3 may be regarded, similarly, as additional electron-to-photon converters. Some of the photons p emitted by phosphor 22 propagate through the substrate plate 18 of gain stage S1 and are absorbed by a photocathode 64 of the same stage. Although each photocathode 64 is shown in the drawings as separated from its associated substrate plate 18, it may be provided as a coating on the back face of the substrate plate. At the photocathode, a portion of the photon energy is converted back to kinetic energy of electrons $e^-$. Thus, each photocathode 64 may be regarded as a photon-to-electron converter.

The electrons generated at the first gain stage S1 are accelerated so as to impact the phosphor coating 22 disposed on a substrate plate 18 of the second gain stage S2 by application of an electrical potential difference between the photocathode 64 of stage S1 and a thin-film metallic electrode 54 disposed on the phosphor 22 of the second gain stage S2. The process of generating photons from the electrons and generating new electrons from the photons, and causing the new electrons to propagate toward the next stage is repeated at stages S2 and S3. More generally, this process is repeated at each gain stage except for the last stage. The final gain stage—stage S4 in the example illustrated in FIG. 2A—does not include a photocathode component. Thus, the output of the final stage is a population of photons.

The final population of photons (i.e., the population of photons generated by cathodoluminescence at the last gain stage) may be focused onto a light detector 25 by a lens assembly 27. In some embodiments, the light detector 25 is provided as a two-dimensional detector, such as a charge-coupled-device (CCD) camera or, a charge injection device (CID) camera, a camera based on complementary metal-oxide-semiconductor technology or as an array of silicon photomultiplier detectors. In alternative embodiments, the detector may be a single channel photo detector to enable simple ion detection. Since the cathodoluminescence may consist of broadband light, an achromatic lens assembly is preferred. In the illustrated example, the lens assembly comprises lens elements 23*a*, 23*b*. Alternatively, the lens doublet could also be replaced either by the fiber optic plate (if employed) or by direct coupling of the detector to phosphor-coated substrate plate or other scintillating material of the final gain stage. The imaging detector system 21 includes a supplementary electrode 14 that, in operation, is electrically biased relative to the MCD 16 so as to repel any back scattered electrons back to the MCD. Note that another important function of the electrode 14 is shielding the space between the electrode 14 and MCD 16 from unfavorable electric field. This shielding works even at zero bias of the electrode 14. Electrons that exit the MCD are thus directed towards the first phosphor layer 22.

FIG. 2B is a schematic illustration of another imaging detector system 31 for a mass spectrometer, as taught in U.S. Pat. No. 9,524,855. Under some circumstances, some of the detector components may be provided within a prefabricated, pre-evacuated and pre-sealed enclosure 71 as illustrated with regard to the detector system 31. The enclosure 71 may comprise, for example, a glass tube. Alternatively, the enclosure 71 may be formed of some non-transparent material other than glass, provided that it includes a window of glass or other transparent material facing and providing an optical line of sight to the first gain stage S1 within the enclosure (see FIG. 2B).

Using the detector configuration illustrated in FIG. 2B, there may be no conventional detector within the high vacuum chamber 9. Instead, a housing or vacuum chamber wall 77 of the mass spectrometer is provided with an aperture 78 with which the enclosure may be mated so as to provide a vacuum seal between the enclosure 71 and the mass spectrometer housing or chamber wall 77. The MCD 16 and optional grid electrode 14 of the detector apparatus are not housed within the enclosure 71 but are, instead, disposed within the high vacuum chamber 9.

The gain stages S1-S4 housed within the enclosure 71 are generally as previously described except that the first gain stage S1 may not comprise a phosphor and may substantially consist of just a photocathode which may or may not be disposed upon a substrate plate. Instead, a phosphor coating 26 may be applied to the outer surface of the glass enclosure or, alternatively, to the transparent window, if present, at a position such that, when the enclosure 71 is mated to the mass spectrometer housing or wall 77, the phosphor coating 26 is disposed along a line of sight between the MCD 16 and the first gain stage S1. With such a configuration, when the detector system 31 is in operation, the phosphor coating 26 is disposed within the high vacuum chamber 9. Photons generated at the phosphor coating 26 pass through the transparent window (if present) or wall of the enclosure 71 so as to create secondary electrons at the photocathode of the first gain stage S1 within the enclosure 71. The enclosure 71 and the components therein may be regarded, when considered together, as an image intensifier 73 which receives a photonic signal from an external photon source—in this instance, phosphor 26—and emits, as output, an amplified version (indicated by the rightmost arrow labeled p) of the original signal.

The final, amplified batch of photons generated at the final gain stage (for example, gain stage S4) within the enclosure are focused by lens assembly 27 onto optical detector 25 as previously described. In some embodiments, the lens assembly 27 and optical detector 25 may be housed within the enclosure 71. In other alternative embodiments, either the optical detector 25 or the lens assembly 27 or both may be housed in an optional, separate enclosure 72. If the lens assembly 27 is not housed within the same enclosure 71 as the gain stages, then the enclosure may comprise a second window disposed such that there is a direct optical line of sight between the final gain stage and the lens assembly 27.

The detector system that is illustrated in FIG. 2B may be modified such that the image intensifier 73 does not form a vacuum seal against the vacuum chamber wall 77 of the mass spectrometer and is, instead, physically separated from the wall by a gap. In such a modified system, an optically transparent window (not shown) may be employed to form a vacuum seal against the wall 77 within the aperture 78. In the modified system, the phosphor coating 26 within the high vacuum chamber 9 is disposed as a coating on the optically transparent window. Photons generated by the phosphor 26 pass out of the high vacuum chamber through the transparent window and then pass into the interior of the image intensifier 73 through either an optically transparent enclosure 71 or, alternatively, a transparent window (not specifically shown) of an otherwise non-transparent enclosure.

FIGS. 3A-3B are schematic cross sections of simple channeled devices that may be employed as a metal-channel conversion dynode 16 of a mass spectrometer detector system as depicted in FIGS. 2A-2B. Metal-channel conversion dynode 16.1 is a cross-section of a venetian-blind type MCD comprising through-going angled channels 17. Electron multiplier detectors are well known in which a plurality of stages venetian-blind type metal-channel conversion dynodes are used to repeatedly amplify an electron signal. One such implementation uses grids between relatively open electrodes to define the field gradient direction thereby directing secondary electrons from one stage to the next. FIG. 3B is a cross-section of a shadow mask 16.2 of the type formerly employed in color-television picture tubes. The device 16.2 comprises scalloped wells 15 as opposed to the straight channels 17 of device 16.1.

Although the U.S. Pat. No. 9,524,855 also teaches substituting micro-channel plates (MCPs) in imaging mass spectrometer detectors in place of the metal-channel conversion dynodes (MCDs) mentioned above, it has been found that such MCP devices are not robust in typical mass spectrometry applications. Conversely, it has been found that metal-channel conversion dynodes exhibit unlimited robust performance in imaging detectors of the type depicted in FIGS. 2A-2B. Unfortunately, imaging detection systems such as those depicted in FIGS. 2A-2B and variants thereof that utilize MCDs have, to date, only been successful in obtaining mass spectral measurements of positively-charged ions. When employing such systems, signals of negative ions are generally not observed at an intensity that is sufficient to generate acceptable mass spectra. However, negative-ion mass spectrometry can provide molecular structural information that is complementary to that obtained from positive-ion mass spectrometry. Negative-charge analyte ions may be readily generated, in electrospray ionization, for example, by changing the polarity of a spray emitter. In chemical ionization, negative-charge ions may be generated by reacting analyte molecules with reagent ions that exhibit either a proton affinity that is stronger than that of the analyte or an electron affinity that is less than that of the analyte. Accordingly, there is a need in the art of mass spectrometry for spatially-resolved detection systems that may readily measure signals of both positive and negative ions.

SUMMARY

This document discloses a means to convert a spatially-resolved positive or negative ion beam into a spatially-resolved electron image that may be subsequently amplified to an easily detected electron or photon image. This has been achieved by the development of a metal-channel conversion dynode electrode geometry based on the venetian blind design, but scaled to a miniature scale with sufficient resolution to capture the nature of an ion beam exiting a quadrupole mass filter. An exemplary MCD device is approximately 150 μm thick and comprises 4096 45-degree angled pores arranged in a 64 by 64 square grid array. The MCD device may be fabricated by a micromachining technique, such as laser micromachining or wire electrical discharge machining (wire-EDM). Alternatively, the MCD device may be fabricated by metallization of a channeled plate fabricated by any of the following technologies: three-dimensional printing, extrusion, stamping, etc. Also, the MCD device may be fabricated by direct 3D printing of a metal channeled plate. Also, the MCD may be fabricated by means similar to a micro channel plate as is well known in the art, but with the aforementioned aspect ratio to exhibit a single ion to surface interaction rather than a typical MCP multi-impact gain cascade. Secondary electrons emitted from the device, which comprise a spatially resolved image of the incident ions, are accelerated to a phosphor screen where a spatially resolved photon image is created.

It has been found both positive and negative ions may be detected when the micro-machined MCD is employed as a component of an imaging detector in a mass spectrometer. Electrons are emitted from the MCD device, in conventional fashion, when the MCD is biased negatively relative to an ion source (such as a quadrupole mass analyzer) and when the phosphor plate is biased positively relative to the MCD. A simple grid or mesh placed between the source and the MCD and held at the MCD bias or negatively biased relative to the MCD increases secondary generation by a factor of nearly 4. Surprisingly, however, no protons are detected under any circumstances when the incoming ions are negative and the MCD is positively biased relative to the source and the phosphor is negatively biased relative to the MCD. This is true with and without a mesh between the source of ions and the MCD. Even more surprisingly, it is observed that significant quantities of secondary electrons are detected when the MCD is biased positively relative to the source and the phosphor is biased positively relative to the MCD. Inclusion of the above-described mesh increases that detection by a factor of 23, making MCD conversion of negative ions to electrons a useful operational mode.

According to a first aspect of the present teachings, a metal-channel conversion dynode comprises: a wafer comprising a first face and a second faces parallel to the first face and having a thickness in the range of 150-1000 μm; and a plurality of channels passing through the wafer from the first face to the second face at a substantially 45-degree angle to a plane of the first face and a plane of the second face, wherein each inter-channel distance, measured between centers of adjacent channels, is substantially equal to the wafer thickness. The channels may be fabricated by laser machining of a blank plate made of tungsten, molybdenum, or a tungsten or molybdenum alloy of 90-99% purity. Alternatively, the wafer may comprise a non-electrically conductive material fabricated by three-dimensional (3D) printing that is coated, on its faces and within its channels, with a metal coating. As another alternative, the channeled wafer may be directly 3D printed in metal. Many metals, such as titanium, are printable in this fashion. As another alternative, the channeled wafer may be manufactured in a manner similar to a micro channel plate and subsequently coated with metal or manufactured from a glass that is sufficiently conductive to prevent charging. Ultimately, it is the surface that determines the device's functionality and the fabrication simply provides the support for that surface.

According to a second aspect of the present teachings, a method of mass spectrometry is provided, the method comprising: causing positively-charged ions to be emitted from a mass analyzer; causing the positively-charged ions to impinge upon a metal-channel conversion dynode (MCD) by providing a negative electrical potential bias to the MCD relative to the mass analyzer; causing a first batch of secondary electrons emitted from the MCD to impinge upon a phosphor-coated optical component by providing a positive electrical potential bias to an electrode that is associated with the phosphor-coated optical component; measuring a signal derived from a first flux of photons that is emitted from the phosphor-coated optical component in response to the impingement of the first batch of secondary electrons; causing negatively-charged ions to be emitted from the mass analyzer; causing the negatively-charged ions to impinge upon the MCD by providing a positive electrical potential bias to the MCD relative to the mass analyzer; causing a second batch of secondary electrons emitted from the MCD to impinge upon the phosphor-coated optical component by providing a positive electrical potential bias to the electrode that is associated with the phosphor-coated optical component; and measuring a signal derived from a second flux of photons that is emitted from the phosphor-coated optical component in response to the impingement of the second batch of secondary electrons.

According to a third aspect of the present teachings, a method of fabricating a metal-channel conversion dynode is provided, the method comprising: (a) fabricating a wafer of a non-electrically-conductive material having a thickness in the range of 150-200 μm, the wafer comprising: a first face and a second faces parallel to the first face; and a plurality of channels passing through the wafer from the first face to the second face at a substantially 45-degree angle to a plane of the first face and a plane of the second face, wherein each inter-channel distance, measured between centers of adjacent channels, in in the range of 150-200 μm; and (b) coating the wafer, on its faces and within its channels, with a metal coating. According to some embodiments, the fabrication of the wafer of the non-electrically-conductive material may be performed by three-dimensional (3D) printing of the wafer using a 3D printer. According to a preferred embodiment, the wafer is fabricated such that each inter-channel distance of the wafer is substantially the same as the wafer thickness.

BRIEF DESCRIPTION OF THE DRAWINGS

The above noted and various other aspects of the present invention will become apparent from the following description which is given by way of example only and with reference to the accompanying drawings, not necessarily drawn to scale, in which.

DETAILED DESCRIPTION

Figure 1:
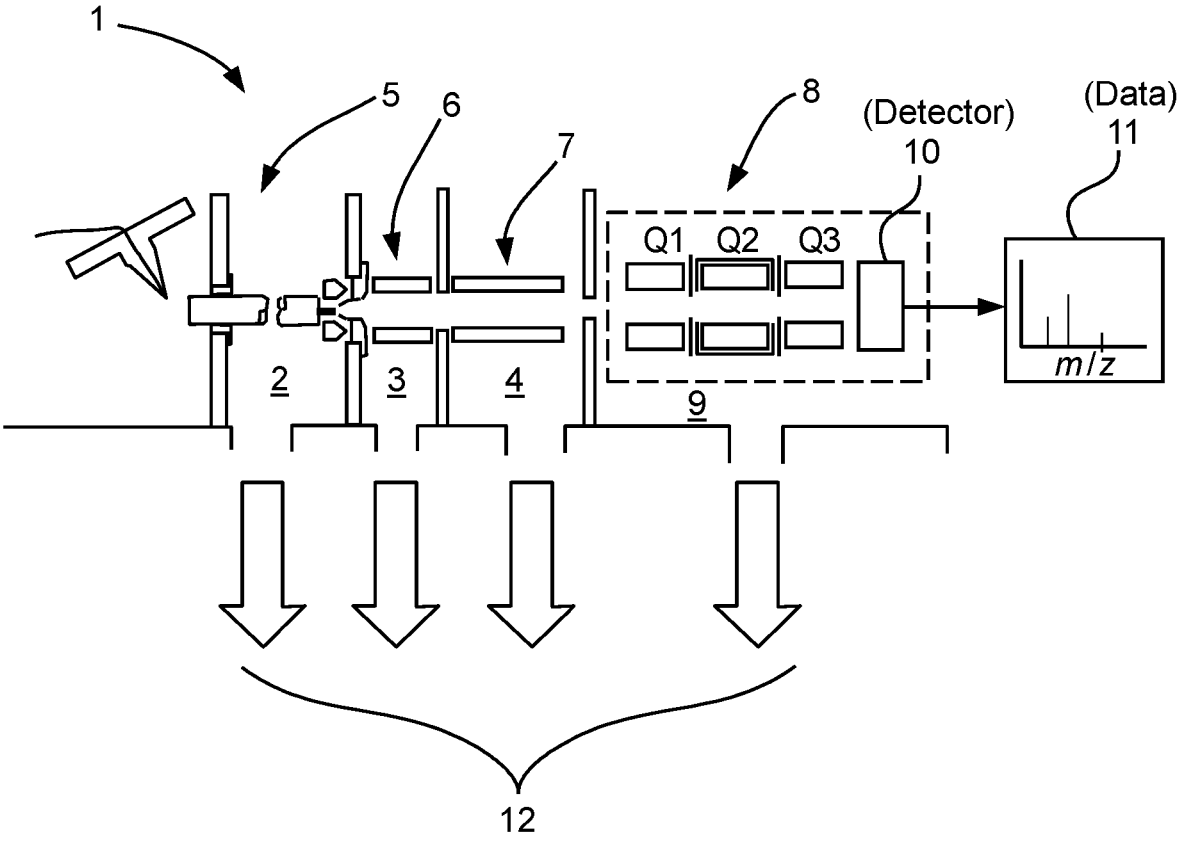
FIG. 1 (Prior Art)
FIG. 1 is a schematic illustration of a conventional triple-quadrupole mass spectrometer system.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. To fully appreciate the features of the present invention in greater detail, please refer to FIGS. 1, 2A-2C, 3A, 3B, 4-6, 7A-7B, 8A-8B and 9 in conjunction with the following description.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

Unless otherwise defined, all other technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. As used herein, "a" or "an" also may refer to "at least one" or "one or more." Also, the use of "or" is inclusive, such that the phrase "A or B" is true when "A" is true, "B" is true, or both "A" and "B" are true.

Figure 4:
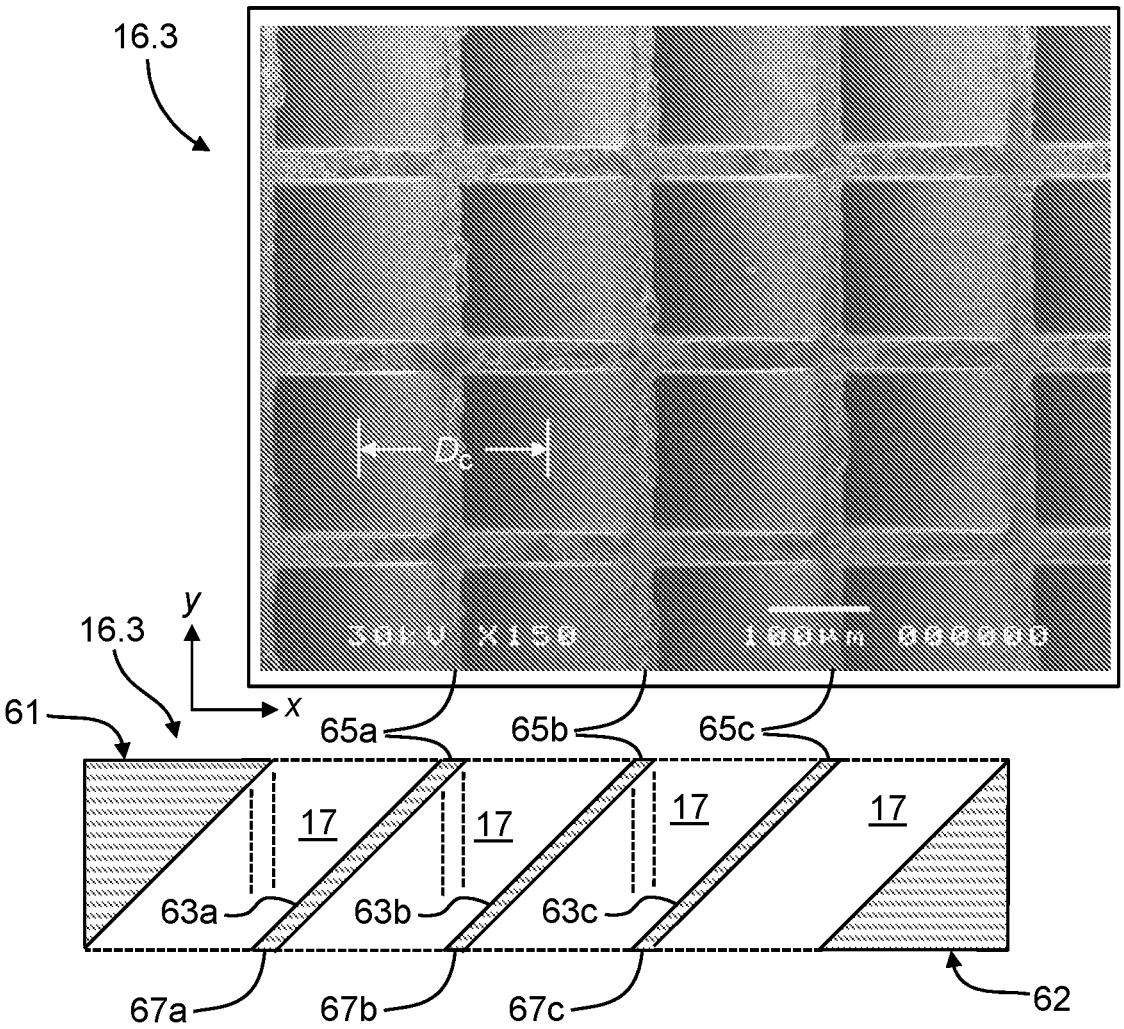
FIG. 4 is a scanning electron microscope image of a metal-channel conversion dynode (MCD) in accordance with the present teaching and a schematic cross section of the channels within the MCD.

FIG. 4 includes, in its upper portion, a scanning electron microscope (SEM) image of a metal-channel conversion dynode (MCD) 16.3 in accordance with the present teachings. The lower portion of FIG. 4 is a schematic cross section of the channels within the MCD 16.3, which is drawn at approximately the same scale as the SEM image. The SEM image was obtained from a small portion of a wafer of tungsten of approximately 150 μm thickness and comprising 4096 pores or channels 17 arranged in a 64 by 64 square grid array. Each pore or channel 17 comprises an approximately square cross section at each wafer surface having dimensions of approximately 150 μm on each side. The walls between the pores/channels are approximately 30 μm thick. The device depicted in FIG. 4 is here termed a micro-venetian-blind metal-channel conversion dynode (micro-venetian-blind MCD). The micro-venetian-blind MCD wafer 16.3 depicted in FIG. 4 was fabricated by laser ablation micro-machining. Alternatively, the device may be fabricated by wire electrical discharge machining (wire-EDM), by chemical etching, or by metallization of a channeled plate of a non-conductive material fabricated by three-dimensional (3D) printing or other means such as those employed to produce micro channel plates. Direct 3D printing of a metal channeled wafer is also possible for many different metals.

Since the pores or channels 17 micro-venetian-blind MCD 16.3 are all slanted at an angle of 45 degrees relative to the wafer surfaces, the relative dimensions of the apparatus assure that each pore or channel comprises a length is not appreciably longer than the length required to just prevent any direct line of sight through the wafer. As is shown in the schematic cross-section in the lower portion of FIG. 4, the wafer 16.3 comprises a planar first face 61 and a second opposite face 62 that is parallel to the first face. The distance between the two faces 61, 62 is the wafer thickness. The 45-degree slant of the channels is defined by slanted walls (e.g., slanted walls 63*a*, 63*b*, 63*c*) that are oriented at 45 degrees to the planar faces 61, 62 and that separate adjacent pores/channels along the x-dimension of the wafer. Each slanted wall comprises a first surface (e.g., first surfaces 65*a*, 65*b*, 65*c*) that is a component of the first face 61 and a second surface (e.g., second surfaces 67*a*, 67*b*, 67*c*) that is a component of the second face 62. The optimal geometry of the micro-venetian-blind MCD 16.3 is achieved when the first surface of each slanted wall is in alignment with a projection, normal to the planar faces, of the second surface of the respective succeeding wall. Such projections are indicated by dotted lines shown in selected channels. For example, the first surface 65*a* of slanted wall 63*a* aligns with the projection (see dotted lines) of the next slanted wall 67*b* in succession along the x-dimension. This geometry assures that, because of the absence of a line of sight through the wafer, all ions will impact some portion of the micro-venetian-blind MCD wafer while, at the same time, that the wafer has a minimum thickness so that there is minimal lateral shift of the image of ions' spatial distribution. With a constant slant angle of 45 degrees, then, if the inter-channel distance, $D_c$, measured between centers of adjacent channels, is uniform across the wafer, then the above geometric relations are fulfilled for all pores/channels if the wafer thickness is equal to the inter-channel distance. Other angles are also possible if the line of sight requirement is met and the field penetration from the subsequent scintillator is sufficient to extract the secondary electrons. Indeed, some literature indicates a benefit from 60-degree impacts.

Figure 5:
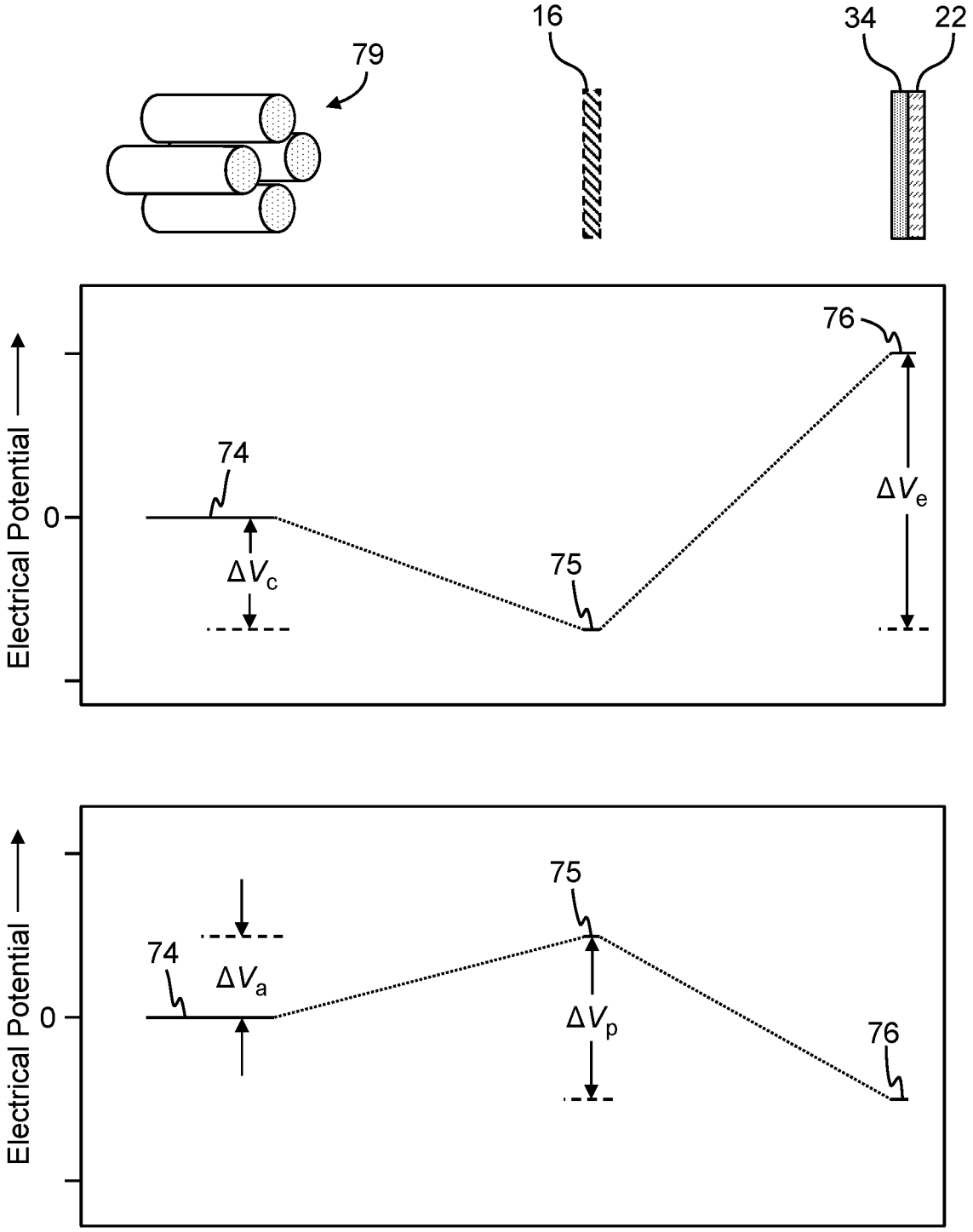
FIG. 5 is a pair of conventional voltage profiles as may be applied between a mass analyzer, a metal-channel conversion dynode (MCD) and a luminescent phosphor component of a mass spectrometer for the detection of positive ions emitted from the mass analyzer (uppermost profile) and the detection of negative ions emitted from the mass analyzer (lowermost profile)
Figure 6:
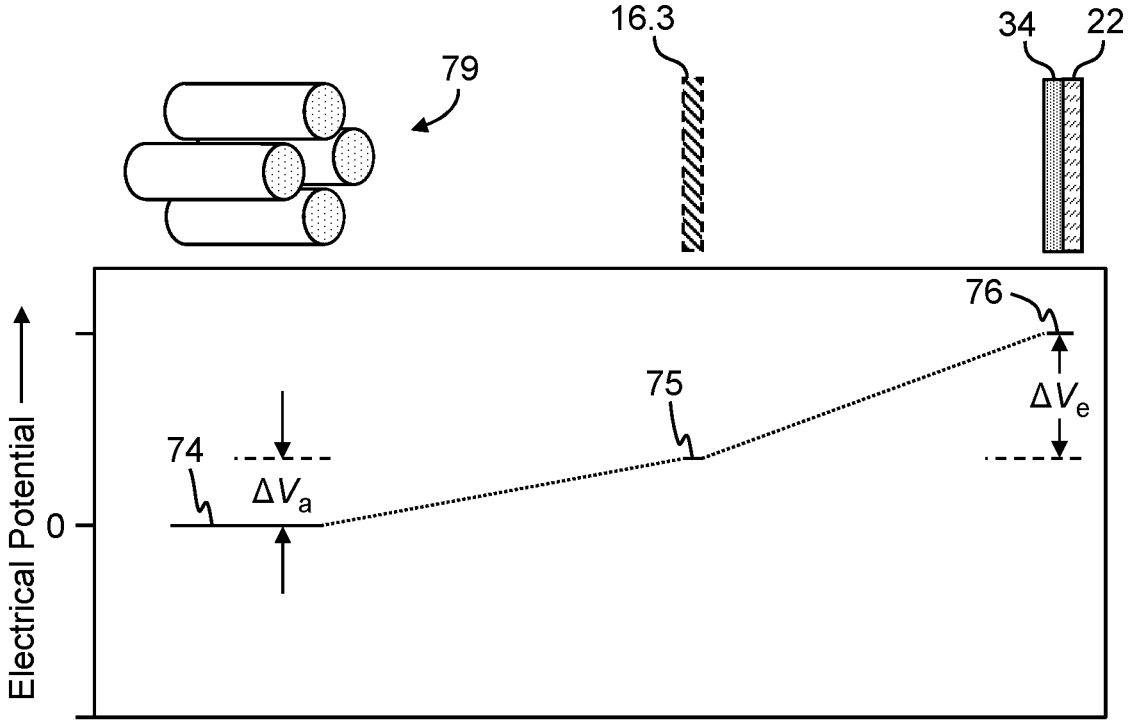
FIG. 6 is a depiction of a voltage profile within a mass spectrometer that is suitable for detecting electrons emitted from a metal-channel conversion dynode in response to impacts from negatively-charge ions.
Figure 9:
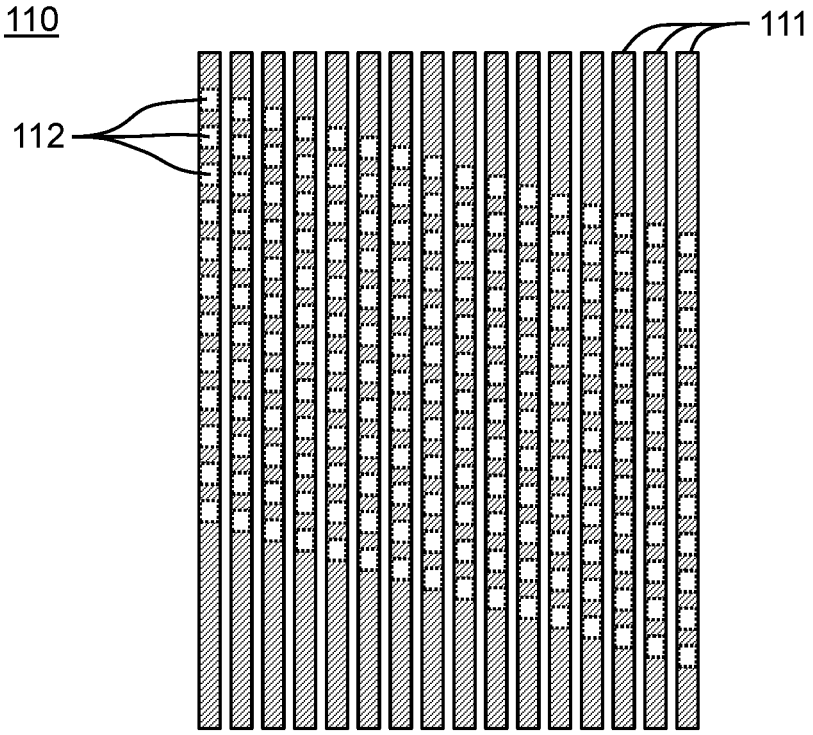
FIG. 9 is a schematic depiction of a cross section of a second metal-channel conversion dynode in accordance with the present teachings.

FIG. 5 is a schematic depiction of conventional voltage profiles 74, 75, 76 as may be employed for the detection of ions emerging from an exit aperture of a mass analyzer 79 such as a quadrupole mass analyzer. In accordance with the mass spectrometer detector systems shown in FIGS. 2A-2B, the voltage profiles 74, 75, 76 are applied between the mass analyzer 79, a metal-channel conversion diode 16 and an electrode 34 that is in contact with a phosphor material 22. The uppermost voltage profile 74, 75, 76 of FIG. 5 is appropriate for the detection of positively charged ions using an imaging detection system 21, 31 comprising any of the MCD devices described herein or variants thereof, such as devices 16.1, 16.2 and 16.3. A negative electrical potential bias of the MCD relative to the mass analyzer 79, by an amount $\Delta V_c$, causes the positive ions to be attracted to and to impact the MCD device. Secondary electrons generated by the impact energy then migrate out of the channels of the MCD 16 and towards the electrode 34 and phosphor 22 a result of the positive bias of electrode 34 by an amount, $\Delta V_e$, relative to the MCD.

According to conventional understanding, the lowermost voltage profile 74, 75, 76 of FIG. 5 would be expected to be appropriate for the detection of negatively charged ions using an imaging detection system that employs a metal-channel conversion dynode, such as systems 21 and 31. The MCD device is biased positively relative to the mass analyzer by an amount $\Delta V_a$, in order to urge the negatively charged ions from the mass analyzer to the MCD device. Because MCD devices commonly emit protons and other positive ions in response to impacts from negatively charged ions, the phosphor electrode 34 is negatively biased by an amount, $\Delta V_p$, relative to the MCD in anticipation of attracting the protons to the phosphor. Surprisingly, however, no secondary protons are detected under any circumstances when a voltage profile 74, 75, 76 of the form shown in the lowermost profile of FIG. 5 is applied to a detection system using the micro-venetian-blind MCD 16.3 (FIG. 5). Instead, when using the micro-venetian-blind MCD 16.3, it is necessary to apply a voltage profile 74, 75, 76 of the form shown in FIG. 6, in which the MCD is positively biased relative to the mass analyzer and the phosphor electrode is further positively biased relative to the MCD by an amount, $A_V G$. Such results imply that electrons are the predominant secondary particles that are emitted from the MCD 16.3 in response to an influx of negative ions.

Without being constrained to any particular theory or hypothesis of the mechanism of why no emissions of secondary protons are observed from the micro-venetian-blind MCD while receiving a flux of negatively charged ions, the inventors put forth the following hypothesis. Specifically, the inventors hypothesize that it is generally the case that both protons and electrons are generated upon initial impact with any MCD, but with protons usually being generated in excess of electrons. The inventors further hypothesize that, within conventional MCD devices, the field penetration from voltages applied on the detector side of the device is sufficient to extract both the protons and electrons from the conductor surface into the various channels. The inventors further hypothesize that, as a result of numerous particle collisions within the conventional channels, essentially all of the electrons and some proportion of the more-abundant protons are neutralized. Accordingly, in operation of conventional MCD devices, only a weak beam of protons is observed. Moreover, the inventors further hypothesize that, as a result of the miniaturized dimensions of the micro-venetian-blind MCD 16.3, the field penetration from voltages applied on the detector side of the device is insufficient to extract protons but is sufficient to extract electrons from the conductor surface. Elementary physics calculations by the inventors indicate that the field penetration is such that essentially all protons generated within a slanted channel are neutralized by collisions with the channel wall when the dynode thickness is less than a certain critical thickness, for example, 1 mm thickness. As a result, appreciable neutralization of the secondary electrons by secondary protons does not occur within the micro-venetian-blind MCD and the secondary electrons thus survive migration through the channels to be emitted and observed.

Figure 7A:
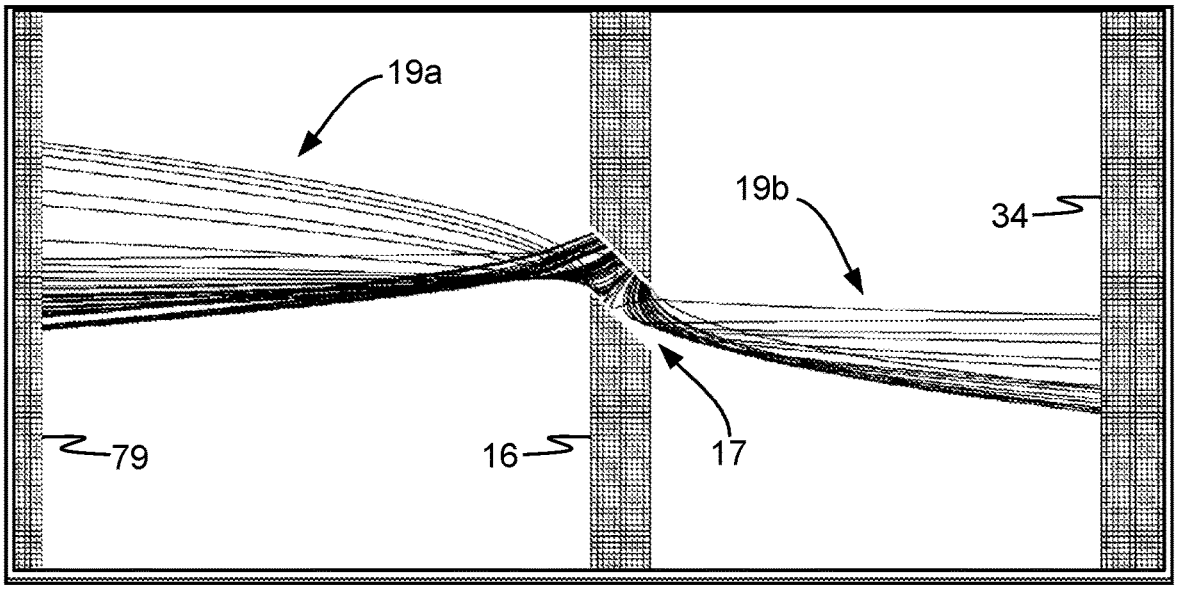
FIG. 7A is simulation of emission trajectories, in two directions, of secondary electrons emitted from a metal-channel conversion dynode (center) within a model system that also comprises a mass analyzer (left) and a biased phosphor element (right), where the emission is in response to impacts from positively-charged ions provided from the mass analyzer.
Figure 7B:
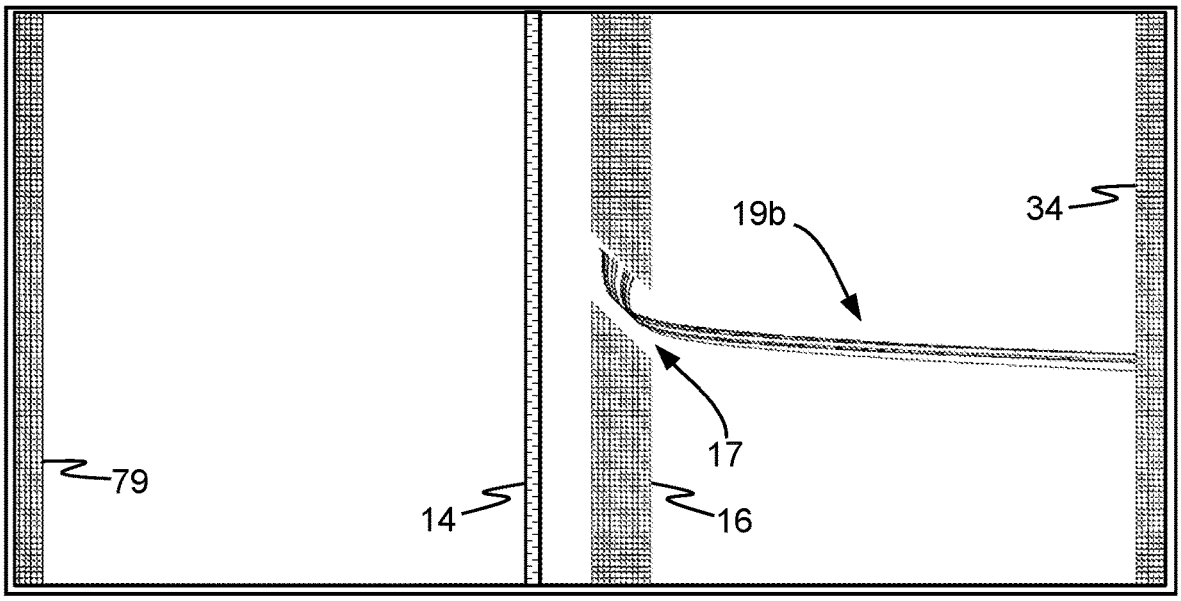
FIG. 7B is simulation of emission trajectories, in one direction, of secondary electrons emitted from the MCD of the model system of FIG. 7A, where the model system is modified by the incorporation of a mesh located at 1 mm distance from the MCD and is maintained at the same electrical potential as the MCD.

FIGS. 7A-7B are simulations, using the SIMION™ commercial simulation software package, of emission trajectories 19*a*, 19*b* of secondary electrons emitted from within a channel 17 of a metal-channel conversion dynode 16 within a model system that also comprises a source of ions (e.g., mass analyzer 79) and a biased phosphor element 34. These simulations assume that ions emitted from the mass analyzer are positively charged and, accordingly, that a voltage profile of the form of the uppermost profile of FIG. 5 is employed. The two simulations differ in that, in the simulation used to generate the results shown in FIG. 7B, the simulation includes the effects of an additional mesh electrode 14 that is disposed between the mass analyzer and the MCD at a distance of 1 mm from the MCD and that is maintained at the same potential as the MCD. From these simulations, it is concluded that, under the modeled experimental conditions and in the absence of the mesh electrode 14, as few as 25% of the secondary electrons created by incoming positive ions are extracted towards the phosphor by field penetration from the electrode 34. The remainder of the electrons are either trapped in the MCD or else exit the MCD channel in the direction of the source of positive ions. The inclusion of the mesh electrode 14 increases the quantity of electrons that arrive at the phosphor electrode 34 by a factor of four. The mesh electrode 14 is expected to give rise to a similar beneficial effect when used in conjunction with the voltage profile depicted in FIG. 6 to detect negative ions. This expectation has been confirmed by experiment.

Figure 8A:
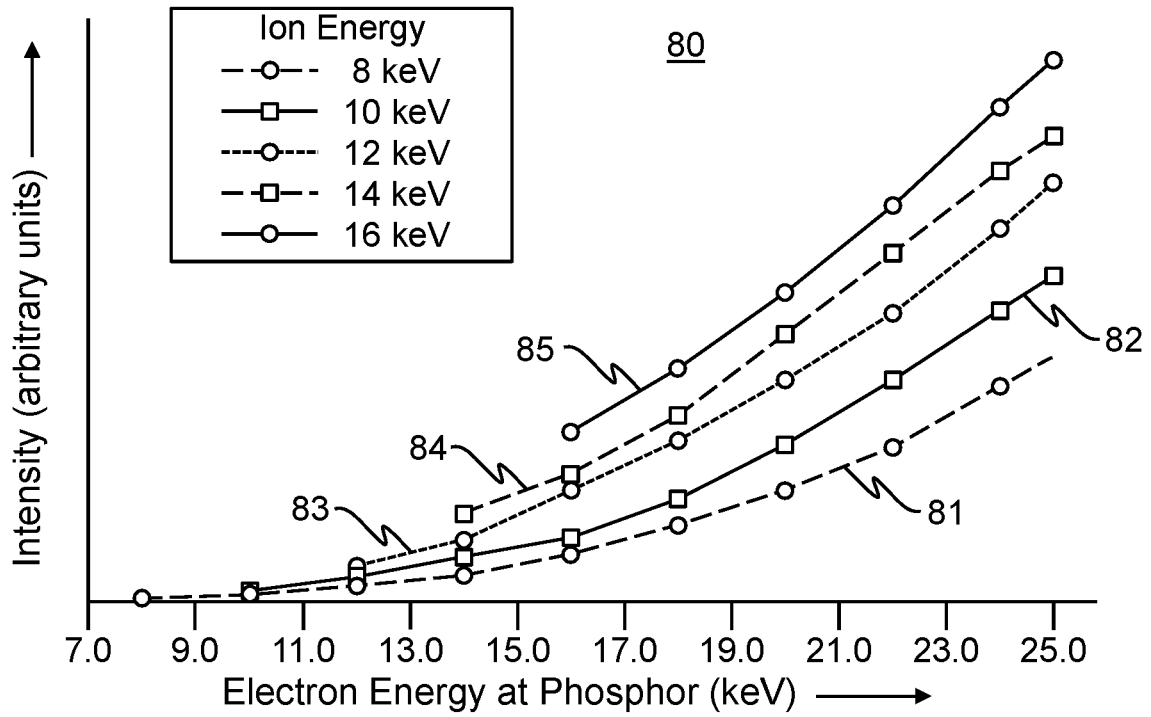
FIG. 8A is a plot of experimental results of signal intensity of detection of positively-charged ions using a voltage profile of the type depicted in the uppermost profile of FIG. 5 as a function of both ion energy and electron energy imparted to particles by the applied voltage profile.
Figure 8B:
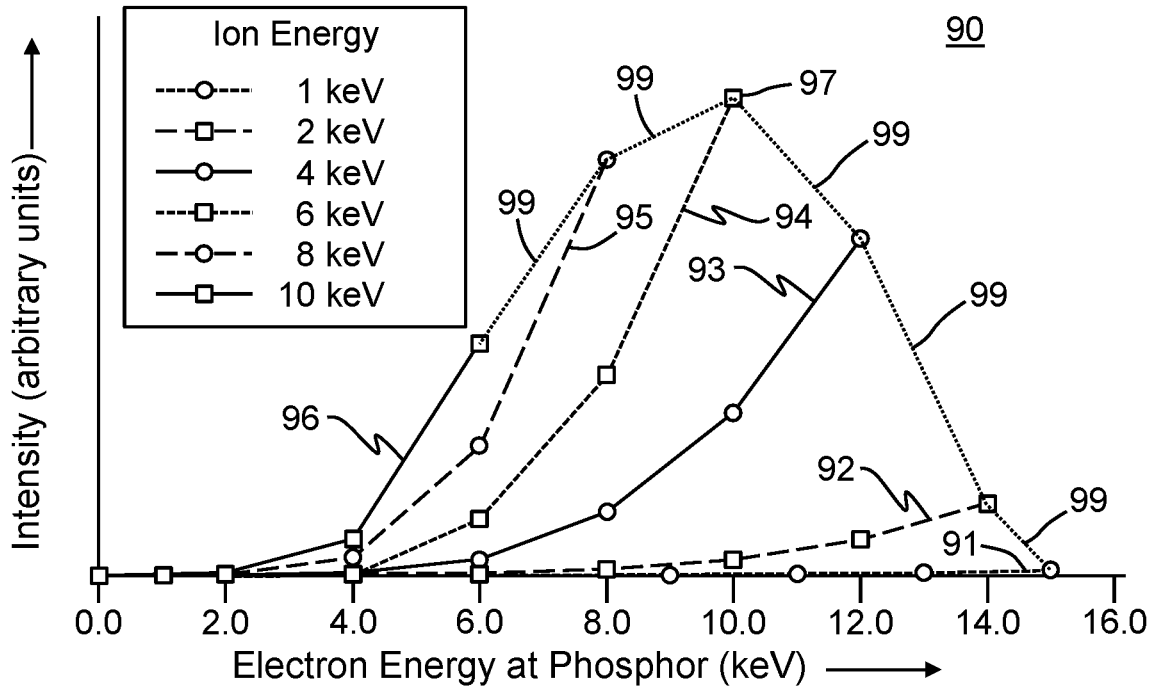
FIG. 8B is a plot of experimental results of signal intensity of detection of negatively-charged ions using a voltage profile of the type depicted in the lowermost profile of FIG. 5 as a function of both ion energy and electron energy imparted to particles by the applied voltage profile.

FIG. 8A is a graphical plot 80 of experimental results of signal intensity of detection of singly-charged positive ions using a detector comprising the MCD 16.3 and a phosphor and using an applied voltage profile of the type depicted in the uppermost profile of FIG. 5. Curves 81, 82, 83, 84 and 85 correspond to induced ion energy values of 8 keV, 10 keV, 12 keV, 14 keV, and 16 keV, respectively. FIG. 8B is a similar graphical plot 90 that relates to detection of negative ions using a profile of the type depicted in FIG. 6. Curves 91, 92, 93, 94, 95 and 96 in FIG. 8B correspond to induced ion energy values of 1 keV, 2 keV, 4 keV, 6 keV, 8 keV and 10 keV, respectively. In general, it may be observed that, with regard to detection of either positive or negative ions, the observed signal increases with an increase in the absolute magnitude of either the induced ion energy or the induced secondary electron energy, which correspond, respectively, to the voltage differences, $\Delta V_a$ and $\Delta V_e$ (see FIGS. 5 and 6).

In any system in which high voltages are applied, the need to prevent corona discharge will lead to a practical maximum, $V_{max}$, to how much voltage may be applied between any two electrodes. This maximum voltage value will generally be dependent on geometry and vacuum pressure. Since the electrical potential at the central axis of the mass analyzer may be assumed to be essentially at ground potential (0 Volts), then, with regard to the uppermost profile of FIG. 5 and the corresponding data of graphical plot 80 in FIG. 8A, it follows that $0 \leq (|\Delta V_e| - |\Delta V_a|) \leq 2V_{max}$. Similarly, with regard to the voltage profile of FIG. 6 and the corresponding data of graphical plot 90 in FIG. 8B, it follows that $0 \leq (|\Delta V_e| + |\Delta V_a|) \leq V_{max}$. It may be observed from the plots in FIGS. 8A-8B that $\Delta V_{max} \approx 16$ kV in the system used to obtain the data. Dotted line 99 in FIG. 8B connects all experimental points for which $|\Delta V_e| + |\Delta V_a| = V_{max}$. The practical limitation on applied voltage gives rise to a practical optimum combination of $\Delta V_e$ and $\Delta V_a$, depicted as point 97 in FIG. 8B, that gives rise to an optimum observed signal.

Figure 2A:
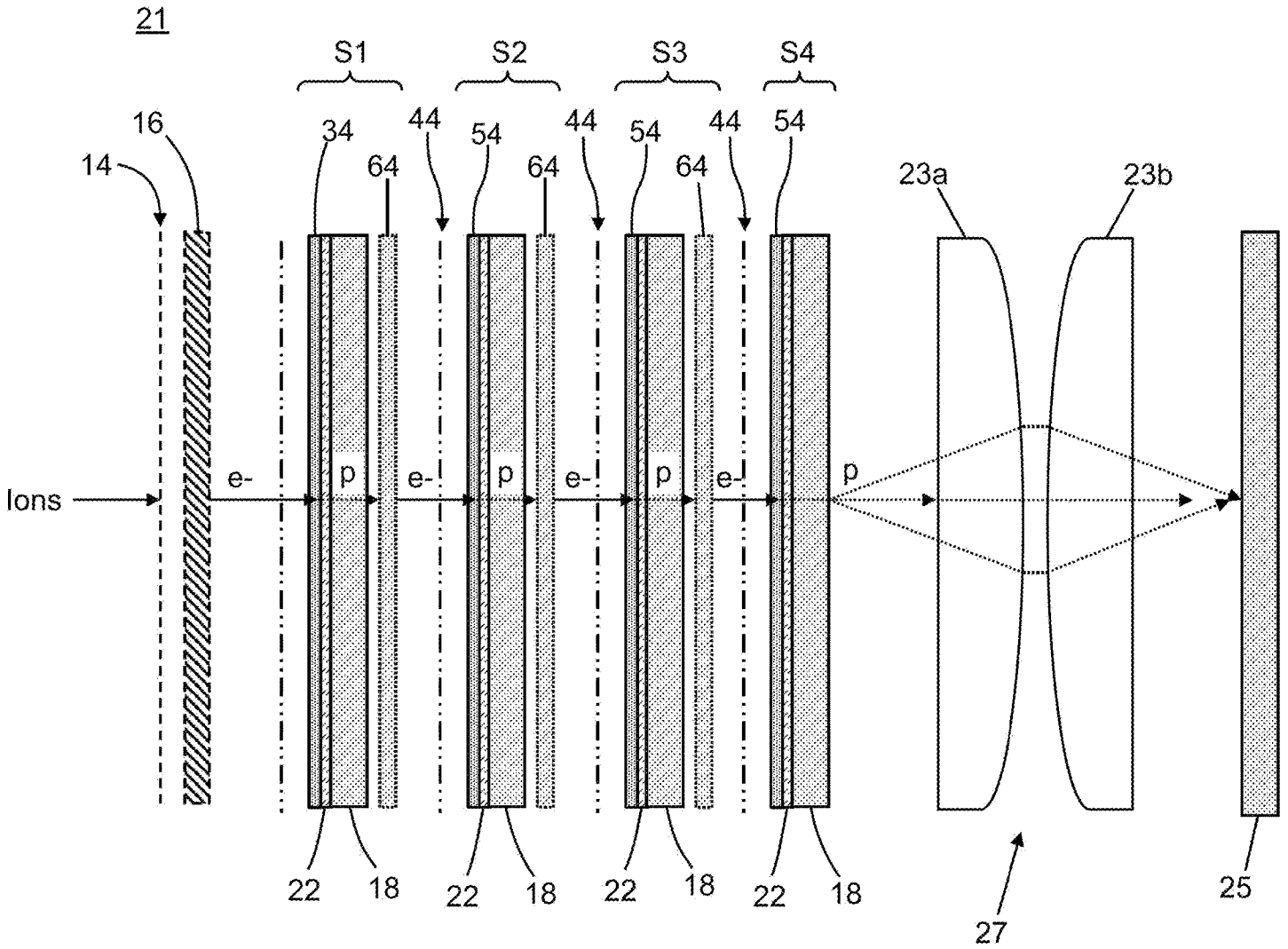
FIG. 2A (Prior Art)
FIG. 2A a schematic illustration of a known imaging detector system for a mass spectrometer that is based on the principle of photomultiplication.
Figure 2B:
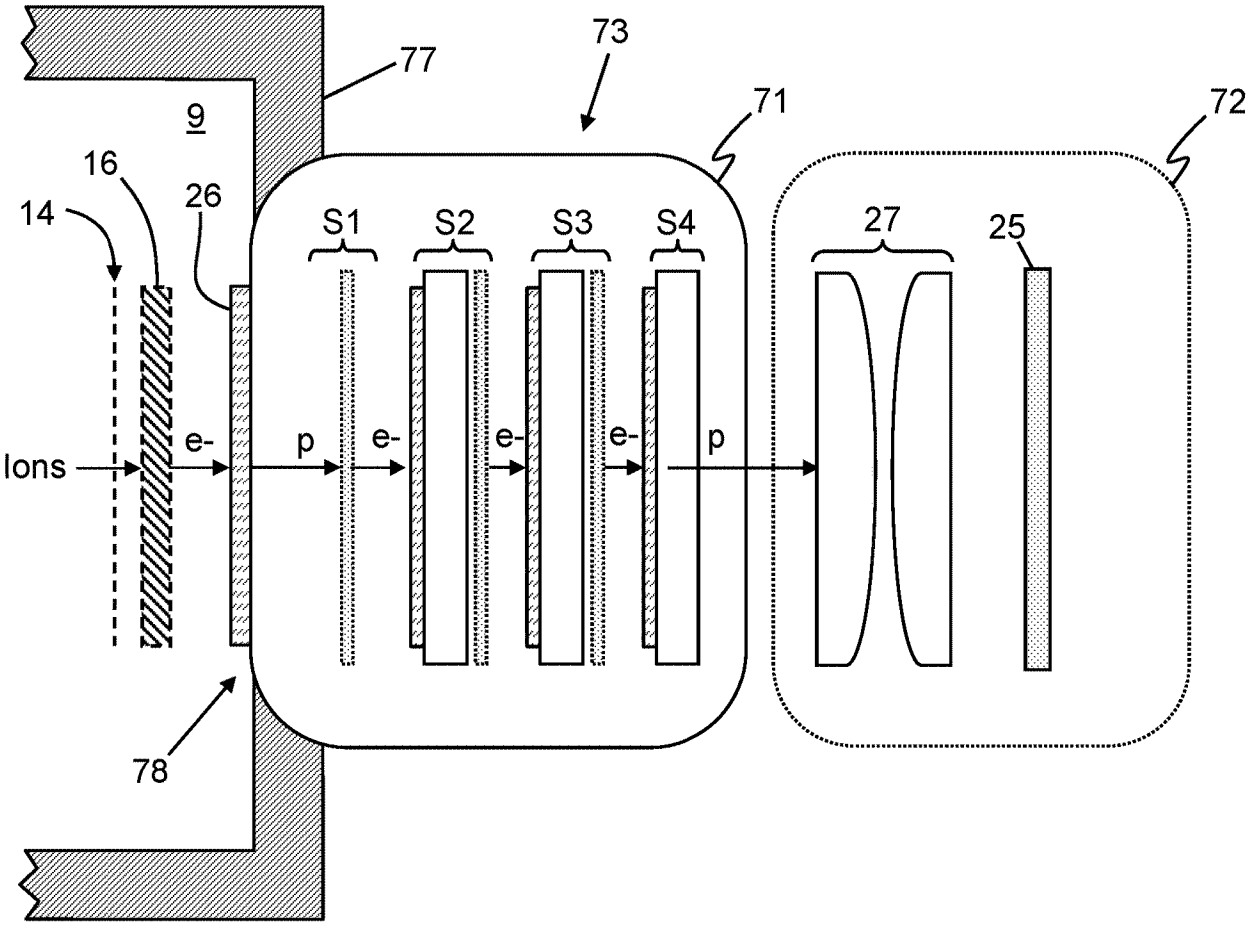
FIG. 2B (Prior Art)
FIG. 2B is a schematic illustration of another known imaging detector system for a mass spectrometer that is based on the principle of photomultiplication.

Although the micro-venetian-blind MCD device of the present teachings performs the essential first step of "converting" a flux of ions, either positive or negative, to a flux of electrons, amplification is required for electronic signal processing. This may be achieved by a simple stack of micro-venetian-blind MCD electron multiplier devices, but a better scheme is to incorporate the micro-venetian-blind MCD into a detection system that include receives the secondary electrons from the MCD converts that image to photons which may then be amplified by image-intensifier components as depicted in FIGS. 2A-2B. The spatial variation of flux of secondary electrons from the MCD reproduces the distribution of ions emerging from a mass analyzer and the spatial variation of photon flux reproduces the spatial variation of the secondary electron flux.

The spatial variation of photons, the flux of which is preferably amplified as discussed above with regard to FIGS. 2A-2B, may be detected as discussed in U.S. Pat. No. 9,524,855. The detector should be configured to record the spatial variation of photon flux. For example, the detection system may include a solid-state camera such as any well-known CMOS imager, a charge injection device (CID) camera or a charge-coupled device (CCD). Alternatively, one or more line-cameras and suitable cylindrical optics or an array of discrete photon detection means (e.g., silicon photomultipliers) may be employed.

Figure 2C:
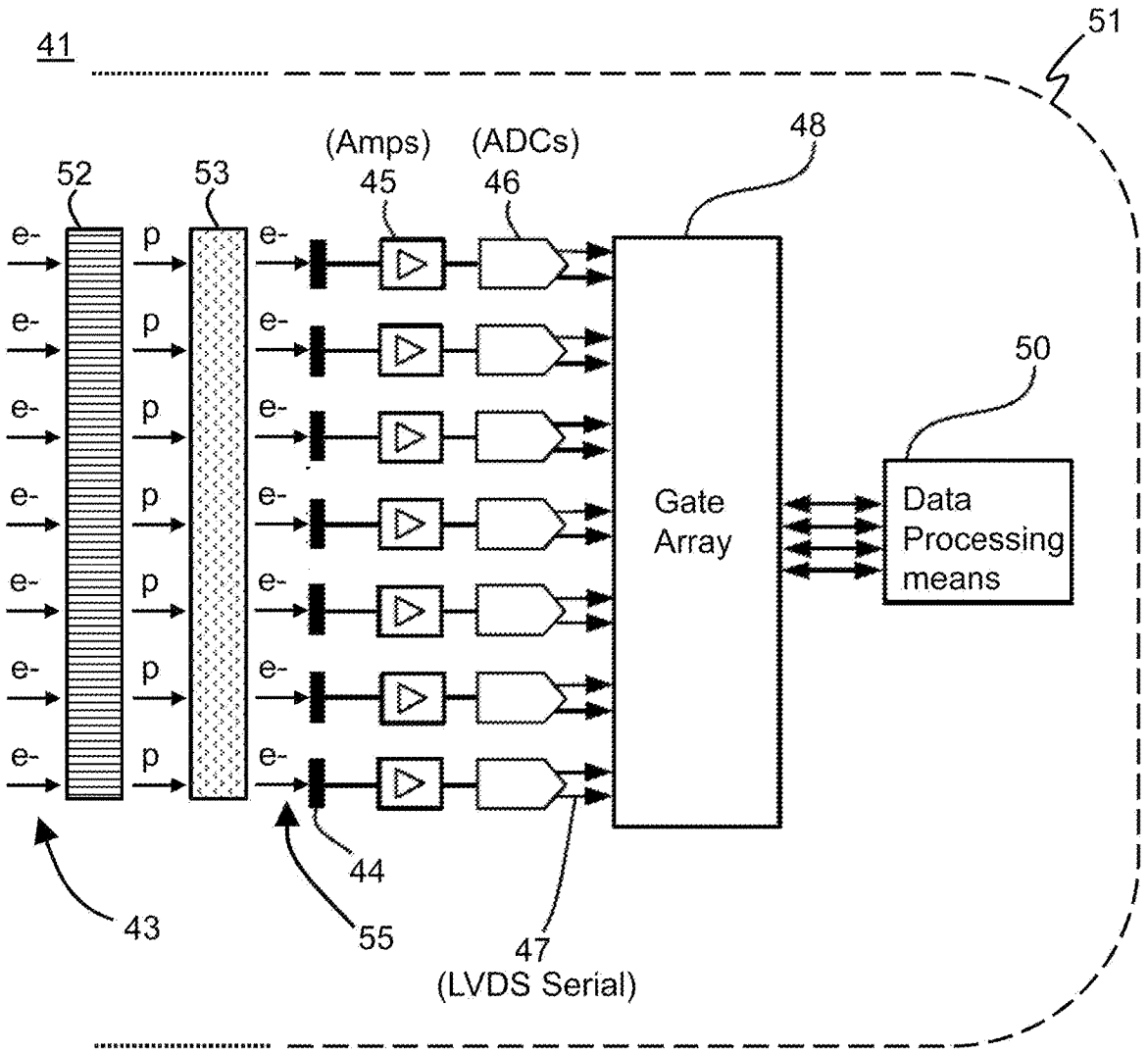
FIG. 2C (Prior Art)
FIG. 2C is a schematic illustration of another known imaging detector system that may be employed in conjunction with the present teachings.
Figure 3A:
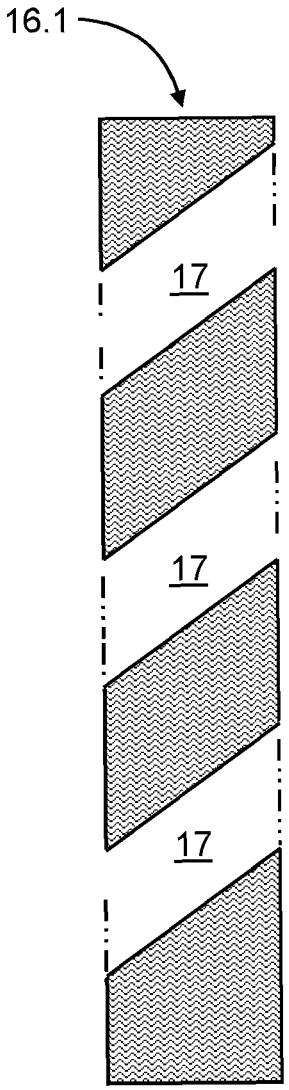
FIG. 3A (Prior Art)
FIGS. 3A and 3B are schematic cross-sectional depictions of channels in a venetian-blind style metal-channel conversion dynode and in a shadow mask, respectively.
Figure 3B:
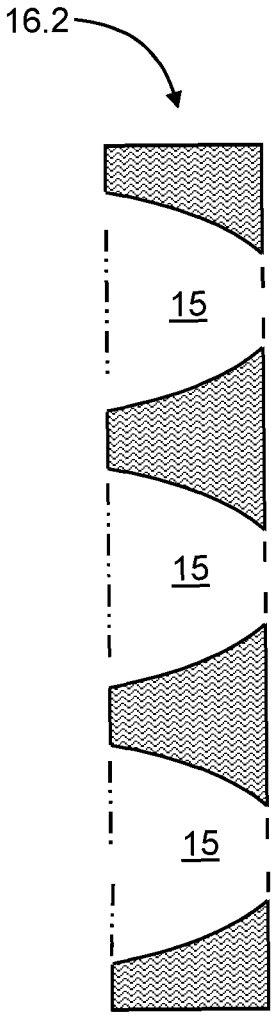
FIG. 3B (Prior Art)

FIG. 2C is a schematic illustration of a portion of an alternative detection system for digitizing a flux of secondary electrons emerging from a metal-channel conversion dynode. The detection system portion 41 depicted in FIG. 2C, details of which are taught in in U.S. Pat. No. 8,389,929, receives a flux of secondary electrons 43 from the MCD at a phosphor-coated optical component, e.g., a phosphor coated fiber optic plate 52. The flux of electrons is drawn to the phosphor-coated optical component under the influence of a positive electrical potential bias, relative to the MCD, that is applied to an electrode (not shown) that is associated with the phosphor-coated optical component. This arrangement converts the signal electrons to a plurality of resultant photons (denoted as p) that are proportional to the amount of received electrons. Generally, a fiber optic plate, as used here, comprises a bundle of a plurality of closely packed, mutually parallel, short lengths of fiber, wherein the coplanar input ends of the plurality of fibers comprise a first face of the plate and the coplanar output ends of the plurality of fibers comprise a second opposite face of the plate. The fiber-optic plate maintains a correspondence between the spatial variation of the secondary electron flux and the spatial variation of the flux of emerging photons. A subsequent photosensitive multichannel plate (MCP) 53 assembly then converts each incoming resultant photon p back into a photoelectron. Each photoelectron generates a cloud of secondary electrons 55 at the back of the photosensitive channel plate 53, which spreads and impacts as one arrangement.

The secondary electrons 55 are received at an array of detection anodes 44, such as, but not limited to, a two-dimensional array of resistive structures, a two-dimensional delay line wedge and strip design, as well as a commercial or custom delay-line anode readout. The anodes 44 are in a sealed vacuum enclosure 51 (as denoted by the dashed vertical rectangle). Each of the anodes 44 can be coupled to a respective independent electrical amplifier 45 and additional analog to digital (ADC) circuitry 46 as is known in the art.

The signals resultant from amplifier 45 and ADC 46 and/or charge integrators (not shown) can eventually be directed to a Field Programmable Gate Array (FPGA) 48 via, for example, a serial LVDS (low-voltage differential signaling) high-speed digital interface 47. An FPGA 48 is beneficial because of the capability of being a configurable co-processor to a computer processing means 50, as shown in FIG. 2C. The data processing means 50 (e.g., a computer, a PC, etc.), can be utilized with a Compute Unified Device Architecture (CUDA) parallel processing Graphics Processing Unit (GPU) subsystem.

Although the micro-venetian-blind metal-channel conversion dynode 16.3 of the present teachings has been described with 4096 channels, it is believed that lower resolution is practical and perhaps desirable in actual practice. If, for example, a detection system includes the system portion 41 depicted in FIG. 2C, a 12×12 array is more reasonable, both from a cost and signal processing perspective. Such a 12×12 MCD could be fabricated from 1 mm individual square devices. In the larger size, this may be approximated, as illustrated by the apparatus 110 shown in FIG. 9, by stacking a number of plates 111 with through holes 112 where each plate has a suitable pattern offset to achieve the 45-degree design or an approximation thereof. The individual holes 112 can be made by chemical etching or electroforming.

Improved apparatus and methods have been herein disclosed converting a flux of positive and/or negative ions into a flux of electrons which comprises an image of the spatial distribution of the original flux of ions. The discussion included in this application is intended to serve as a basic description. The present invention is not intended to be limited in scope by the specific embodiments described herein, which are intended as single illustrations of individual aspects of the invention, and functionally equivalent methods and components are within the scope of the invention.

Various other modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

We claim:

1. A metal-channel conversion dynode comprising:

a wafer comprising a first face and a second face parallel to the first face, the wafer having a thickness less than 1000 μm and comprising either tungsten, molybdenum, or a tungsten or molybdenum alloy having chemical purity of 90-99%; and a plurality of channels passing through the wafer from the first face to the second face at an angle to a plane of the first face and a plane of the second face, wherein no direct line of sight exists through any channel in the plurality of channels of the wafer along a sightline that is normal to the first and second faces.

2. A metal-channel conversion dynode as recited in claim 1 wherein each inter-channel distance, measured between centers of adjacent channels, is in the range of 150-1000 μm.

3. A metal-channel conversion dynode as recited in claim 1 wherein the wafer comprises a non-conductive material that is coated, on its faces and within its channels, with a metal coating.

4. A metal-channel conversion dynode as recited in claim 1, wherein each inter-channel distance is substantially the same as the wafer thickness.

5. A metal-channel conversion dynode as recited in claim 1, wherein each channel comprises a square cross section at its intersection with each face.

6. A metal-channel conversion dynode as recited in claim 1, wherein the wafer is fabricated by three-dimensional (3D) printing by a 3D printer.

7. A metal-channel conversion dynode as recited in claim 1, wherein the wafer, including the channels passing therethrough, is fabricated by three-dimensional (3D) printing of metal.

8. The metal-channel conversion dynode as recited in claim 1, further comprising a plurality of slanted walls that define the plurality of channels.

9. The metal-channel conversion dynode as recited in claim 8, wherein a top surface of a first slanted wall in the plurality of slanted walls is in alignment with a projection, normal to the first face and the second face of the wafer, of a bottom surface of a second slanted wall in the plurality of slanted walls.

* * * * *